US008398461B2

(12) United States Patent
Wang

(10) Patent No.: US 8,398,461 B2
(45) Date of Patent: Mar. 19, 2013

(54) POLISHING METHOD, POLISHING PAD AND POLISHING SYSTEM

(75) Inventor: Yu-Piao Wang, Hsinchu County (TW)

(73) Assignee: IV Technologies Co., Ltd., Taichung (TW)

( * ) Notice: Subject to any disclaimer, the term of this patent is extended or adjusted under 35 U.S.C. 154(b) by 387 days.

(21) Appl. No.: 12/691,184

(22) Filed: Jan. 21, 2010

(65) Prior Publication Data

US 2011/0014853 A1 Jan. 20, 2011

(30) Foreign Application Priority Data

Jul. 20, 2009 (TW) ..... 98124439 A

(51) Int. Cl.
*B24B 1/00* (2006.01)

(52) U.S. Cl. ..... 451/41; 451/527; 451/285; 451/287; 451/529

(58) Field of Classification Search ..... 451/60, 451/550, 548, 285–289, 527–533, 41
See application file for complete search history.

(56) References Cited

U.S. PATENT DOCUMENTS

| | | | | |
|---|---|---|---|---|
| 5,177,908 | A * | 1/1993 | Tuttle | 451/41 |
| 5,650,039 | A * | 7/1997 | Talieh | 216/89 |
| 5,690,540 | A * | 11/1997 | Elliott et al. | 451/41 |
| 5,882,251 | A * | 3/1999 | Berman et al. | 451/527 |
| 5,984,769 | A * | 11/1999 | Bennett et al. | 451/527 |
| 6,019,666 | A * | 2/2000 | Roberts et al. | 451/36 |
| 6,238,271 | B1 * | 5/2001 | Cesna | 451/41 |
| 6,312,324 | B1 * | 11/2001 | Mitsui et al. | 451/540 |
| 6,527,624 | B1 * | 3/2003 | Tolles et al. | 451/41 |
| 6,607,428 | B2 * | 8/2003 | Tolles | 451/286 |
| 6,612,916 | B2 * | 9/2003 | Kollodge et al. | 451/527 |
| 6,685,548 | B2 * | 2/2004 | Chen et al. | 451/526 |
| 6,699,115 | B2 * | 3/2004 | Osterheld et al. | 451/527 |
| 6,729,950 | B2 * | 5/2004 | Park et al. | 451/528 |
| 6,852,020 | B2 * | 2/2005 | Petroski et al. | 451/526 |
| 6,951,506 | B2 * | 10/2005 | Andideh et al. | 451/41 |
| 6,951,510 | B1 * | 10/2005 | Rodriguez et al. | 451/56 |
| 6,955,587 | B2 * | 10/2005 | Muldowney | 451/41 |
| 7,121,938 | B2 * | 10/2006 | Suzuki | 451/527 |
| 7,125,318 | B2 * | 10/2006 | Muldowney | 451/41 |
| 7,255,633 | B2 * | 8/2007 | Muldowney | 451/56 |
| 7,258,602 | B2 * | 8/2007 | Shih et al. | 451/527 |
| 7,267,610 | B1 * | 9/2007 | Elmufdi et al. | 451/530 |
| 7,364,497 | B2 * | 4/2008 | Park et al. | 451/285 |
| 2004/0053570 | A1 * | 3/2004 | Naujok | 451/527 |
| 2004/0142638 | A1 * | 7/2004 | Petroski et al. | 451/41 |
| 2005/0085169 | A1 * | 4/2005 | Cooper et al. | 451/41 |
| 2010/0009601 | A1 * | 1/2010 | Wang | 451/36 |
| 2011/0014853 | A1 * | 1/2011 | Wang | 451/28 |

FOREIGN PATENT DOCUMENTS

JP 61297082 A * 12/1986

* cited by examiner

*Primary Examiner* — George Nguyen
(74) *Attorney, Agent, or Firm* — Ditthavong Mori & Steiner, P.C.

(57) ABSTRACT

A polishing method, a polishing pad and a polishing system are provided. In the invention, the polishing pad is used to polish a polishing article. The polishing pad includes a polishing layer and a surface pattern disposed in the polishing layer. The polishing layer includes a polishing surface, a rotating central region, and a peripheral region. The surface pattern includes many grooves distributed from near the rotating central region and extending outward to near the peripheral region. The grooves include many groove cross sections along a circumferential direction of a same radius. Each of the groove cross sections has a left sidewall and a right sidewall. An included angle is formed by the polishing surface and one of a group of the left sidewalls and a group of the right sidewalls. The included angle is an obtuse angle.

50 Claims, 8 Drawing Sheets

POLISHING METHOD, POLISHING PAD AND POLISHING SYSTEM

CROSS-REFERENCE TO RELATED APPLICATION

This application claims the priority benefit of Taiwan application serial no. 98124439, filed Jul. 20, 2009. The entirety of the above-mentioned patent application is hereby incorporated by reference herein and made a part of specification.

BACKGROUND OF THE INVENTION

1. Field of the Invention

The invention is related to a polishing technique, and more particularly to a polishing pad, a polishing system and a polishing method capable of enabling a slurry to have a different flow distribution.

2. Description of Related Art

With the progress of the industries, planarization processes are often adopted as processes for manufacturing various devices. Chemical mechanical polishing (CMP) processes are often used in the planarization processes in the industries. General speaking, the chemical mechanical polishing processes are performed by supplying a slurry which has chemical mixtures on a polishing pad, applying a pressure on the article to be polished to press it on the polishing pad, and providing a relative motion between the article and the polishing pad. Through the mechanical friction generated by the relative motion and the chemical effects of the slurry, a portion of the surface layer of the article is removed to make the surface flat and smooth so as to achieve planarization.

FIG. 1 is a schematic top view of a conventional polishing pad, and FIG. 1A is a cross-sectional view of the polishing pad taken along a line A-A' in FIG. 1. Referring to FIG. 1, a polishing pad 100 includes a polishing layer 102 and a plurality of circumferential grooves 104. The plurality of circumferential grooves 104 are disposed in a concentric arrangement in the polishing layer 102 to contain the slurry. When the polishing process is performed, the polishing layer 102 contacts a surface of an article 105 (e.g. a wafer), and the polishing pad 100 rotates along a rotational direction 101 simultaneously. At the same time when the polishing pad 100 is rotating, the slurry is continuously supplied to the polishing pad 100 and flows between the polishing layer 102 and the article 105.

Referring to FIG. 1A, due to the centrifugal force generated from the rotation of the polishing pad 100, a part of the slurry flows outward in a radial direction from the circumferential grooves 104 to the surface of the polishing layer 102, as shown by a flowing direction 103. During the polishing process, a flow distribution of the slurry affects polishing characteristics. Therefore, it is necessary to provide polishing pads which have different flow distributions for industry in response to the requirements of various polishing processes.

SUMMARY OF THE INVENTION

Accordingly, the present invention provides a polishing pad which enables the slurry to have a different flow distribution.

The present invention further provides a polishing system which enables the slurry to have a different flow distribution.

The present invention further provides a polishing method which enables the slurry to have a different flow distribution.

The present invention provides a polishing pad which includes a polishing layer and a surface pattern disposed in the polishing layer. The polishing layer includes a polishing surface, a rotating central region and a peripheral region. The above surface pattern includes at least a plurality of grooves distributed from near the rotating central region and extending outward to near the peripheral region, wherein the grooves include a plurality of groove cross sections along a circumferential direction of a same radius, each of the groove cross sections has a left sidewall and a right sidewall, a first included angle is formed by the polishing surface and one of a group of the left sidewalls and a group of the right sidewalls, and the first included angle is an obtuse angle.

The present invention provides a polishing pad suitable for a polishing system having a rotational direction. The polishing pad includes a polishing layer and a surface pattern disposed in the polishing layer. The polishing layer includes a polishing surface, a rotating central region and a peripheral region. The above surface pattern includes at least a plurality of grooves distributed from near the rotating central region and extending outward to near the peripheral region, wherein the grooves include a plurality of groove cross sections along a circumferential direction of a same radius, each of the groove cross sections has a left sidewall and a right sidewall, the left and right sidewalls have an inclined direction from bottom to top thereof, and the inclined direction is opposite to the above rotational direction.

The present invention provides a polishing system which includes a carrier and a polishing pad. The above carrier is used to hold the polishing article, and the polishing pad is fixed on the polishing platen. In addition, the above polishing pad includes a polishing layer and a surface pattern disposed in the polishing layer. The polishing layer includes a polishing surface, a rotating central region and a peripheral region. The above surface pattern includes at least a plurality of grooves distributed from near the rotating central region and extending outward to near the peripheral region, wherein the grooves include a plurality of groove cross sections along a circumferential direction of a same radius, each of the groove cross sections has a left sidewall and a right sidewall, a first included angle is formed by the polishing surface and one of a group of the left sidewalls and a group of the right sidewalls, and the first included angle is an obtuse angle.

The present invention provides a polishing system which includes a carrier and a polishing pad. The above carrier is used to hold the polishing article, and the polishing pad is fixed on a polishing platen which has a rotational direction. In addition, the above polishing pad includes a polishing layer and a surface pattern disposed in the polishing layer. The polishing layer includes a polishing surface, a rotating central region and a peripheral region. The above surface pattern includes at least a plurality of grooves distributed from near the rotating central region and extending outward to near the peripheral region, wherein the grooves include a plurality of groove cross sections along a circumferential direction of a same radius, each of the groove cross sections has a left sidewall and a right sidewall, the left and right sidewalls have an inclined direction from bottom to top thereof, and the inclined direction is opposite to the above rotational direction.

The present invention provides a polishing method. First, a polishing pad is used to polish a polishing article. The polishing pad rotates along a rotational direction. The above polishing pad includes a polishing layer and a surface pattern disposed in the polishing layer. The polishing layer includes a polishing surface, a rotating central region and a peripheral region. The above surface pattern includes a plurality of grooves which are distributed from near the rotating central region and extending outward to near the peripheral region. The grooves include many groove cross sections along a circumferential direction of a same radius, and each of the groove cross sections of the grooves has a left sidewall and a right sidewall. An included angle formed by one of a group of the left sidewalls and a group of the right sidewalls and the polishing surface is an obtuse angle.

The present invention provides a polishing method. First, a polishing pad is used to polish a polishing article. The polishing pad rotates along a rotational direction. The above polishing pad includes a polishing layer and a surface pattern disposed in the polishing layer. The polishing layer includes a polishing surface, a rotating central region and a peripheral region. The above surface pattern includes a plurality of grooves which are distributed from near the rotating central region and extending outward to near the peripheral region. The grooves include a plurality of groove cross sections along a circumferential direction of a same radius, each of the groove cross sections has a left sidewall and a right sidewall, the left and right sidewalls have an inclined direction from bottom to top thereof, and the inclined direction is opposite to the above rotational direction.

In the polishing pad, polishing system, and polishing method of the invention, because the polishing pad includes the groove sidewalls which have the inclined direction, the slurry flows along the inclined direction of the groove sidewalls to the surface of the polishing layer, so that the slurry has a different flow distribution.

In order to make the above and other objects, features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

FIGS. 2A to 2F are each a top view of a polishing pad according to an embodiment of the present invention. According to the present embodiment, a polishing pad 200 rotates counter-clockwise along a direction of an arrow 211. A polishing layer of the polishing pad 200 includes a polishing surface and a surface pattern which is disposed in the polishing layer, and the surface pattern includes a plurality of grooves distributed from near a rotating central region and extending outward to near a peripheral region (as shown by thick dark lines in FIGS. 2A to 2F). The grooves include a plurality of groove cross sections along a circumferential direction of a same radius, and each of the groove cross sections of the grooves has a left sidewall and a right sidewall. An included angle formed by one of a group of the left sidewalls and a group of the right sidewalls and the polishing surface is an obtuse angle. According to an embodiment, the groove sidewalls have, from bottom to top thereof, an inclined direction, and the inclined direction is a direction opposite to the rotational direction 211 of the polishing pad 200.

Figure 1:
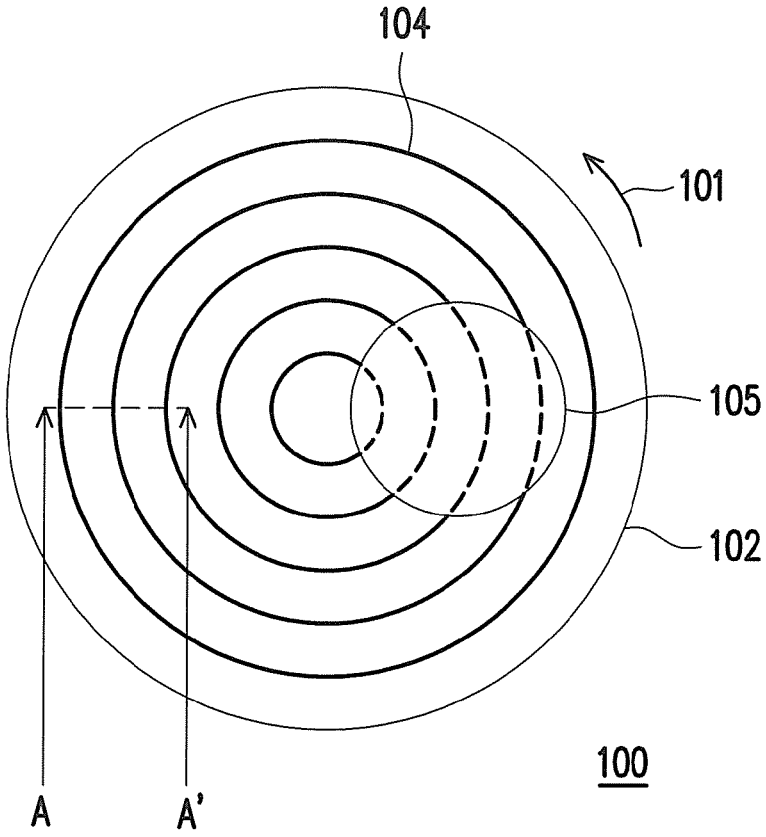
FIG. 1 (RELATED ART)
FIG. 1 is a schematic top view of a conventional polishing pad.
Figure 1A:
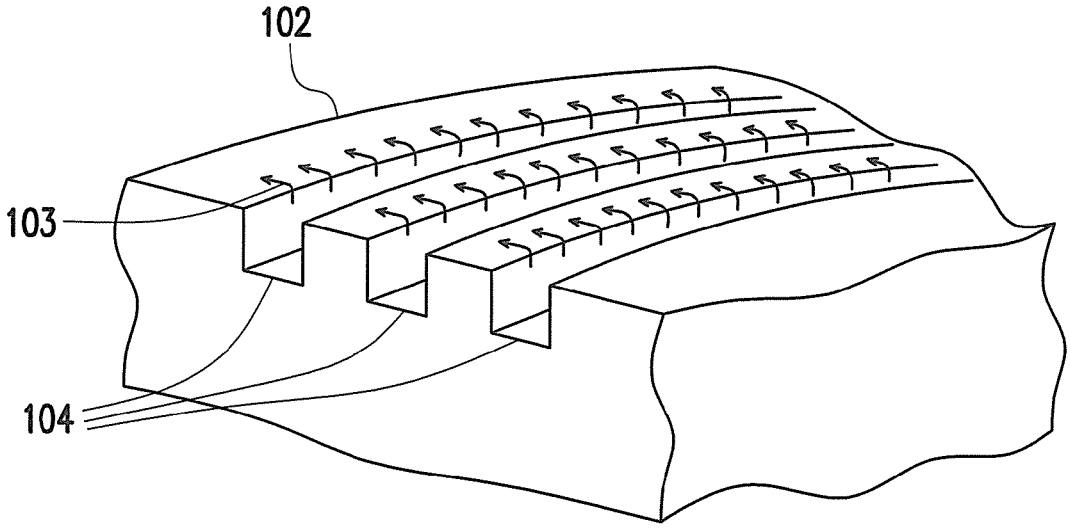
FIG. 1A(RELATED ART)
FIG. 1A is a cross-sectional view of the polishing pad taken along a line A-A' in FIG. 1.
Figure 2A:
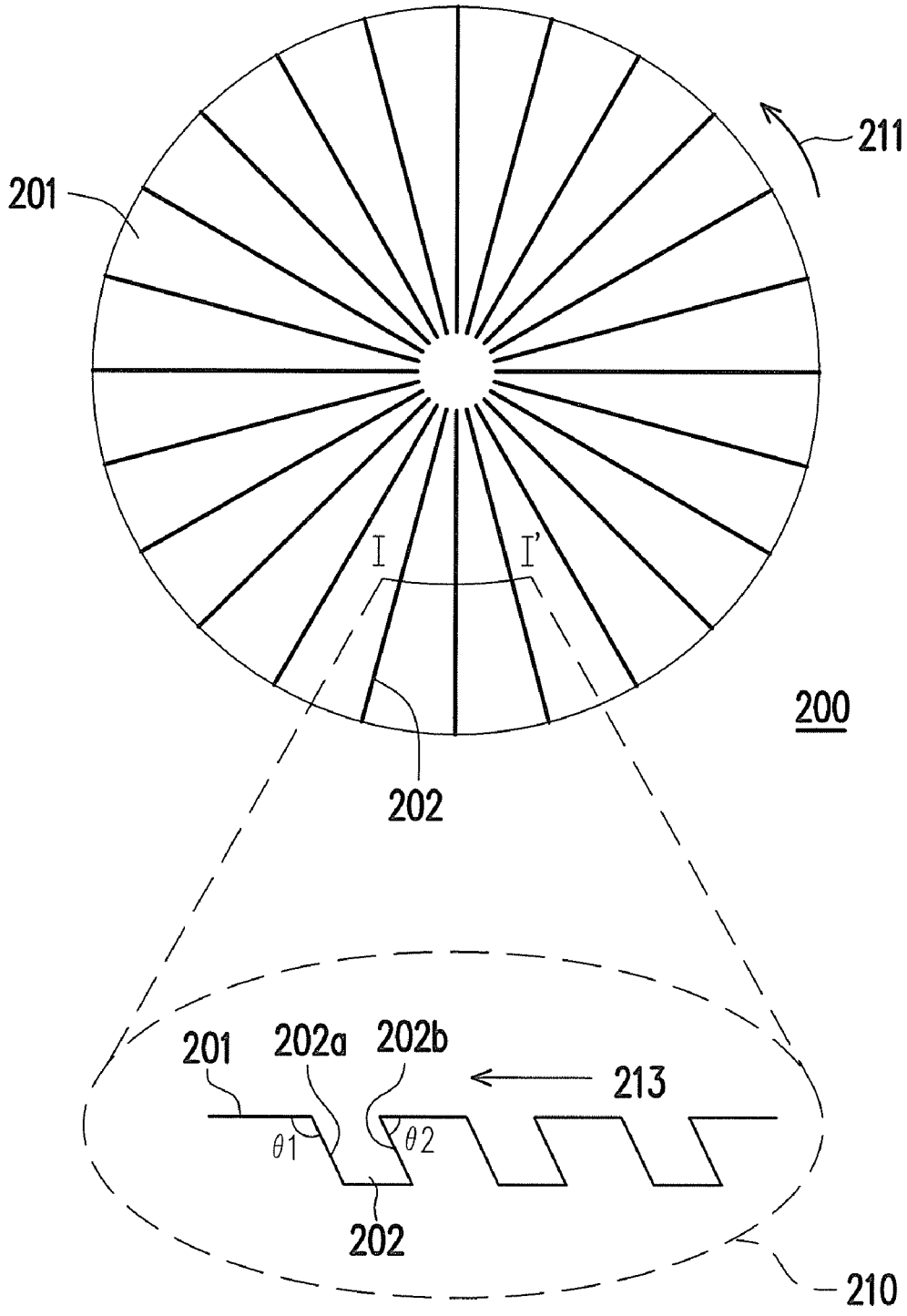
FIGS. 2A to 2F are each a top view of a polishing pad according to an embodiment of the present invention.

Referring to FIG. 2A, grooves 202 have a linear shape, and the surface pattern formed thereby is disposed in the polishing layer in a radial arrangement. Virtual extension lines of the grooves 202 cross the rotational center. In other words, an end (inner side end) of each of the grooves 202 is near the rotational center, and another end (outer side end) is near the peripheral region. However, the grooves may also cross the rotational center, so that the two ends thereof are near the peripheral region, as shown by the grooves 202 in FIGS. 2B and 2C.

The grooves include a plurality of groove cross sections along the circumferential direction of the same radius, and each of the groove cross sections has the two sidewalls. For convenience of illustration, the following is described by groove cross sections 210 of the same radius along circumferential line I-I'. Each of the groove cross sections 210 has a left sidewall 202*a* and a right sidewall 202*b* (which are viewed from the peripheral region to the rotating central region), wherein a first included angle θ1 between the left sidewall 202*a* and a polishing surface 201 is an obtuse angle, meaning that the angle θ1 is greater than 90 degrees, and a second included angle θ2 between the right sidewall 202*b* and the polishing surface 201 is an acute angle, meaning that the angle θ2 is less than 90 degrees. Relative to the rotational direction (as shown by the arrow 211) of the polishing pad 200, the right sidewall 202*b* is the front sidewall 202*b*, and the left sidewall 202*a* is the rear sidewall 202*a*. In other words, relative to the rotational direction 211 of the polishing pad 200, the included angle between the rear sidewall 202*a* of each of the groove cross sections 210 and the polishing surface 201 is an obtuse angle. In other words, relative to the rotational direction 211 of the polishing pad 200, the rear sidewall 202*a* of each of the groove cross sections 210 has an inclined angle. Although the groove cross sections 210 described above are illustrated as having the same inclined angle, the invention is not limited thereto. Each of the groove cross sections may have different inclined angles.

When the polishing pad 200 is rotating, relative to the rotational direction (as shown by arrow 211) of the polishing pad 200, the slurry flows to the polishing surface 201 along a direction (as shown by an arrow 213) opposite to the rotational direction of the polishing pad 200. Accordingly, when the rear sidewall 202*a* of each of the grooves 202 relative to the rotational direction 211 of the polishing pad 200 has an inclined angle, the slurry in the grooves 202 flows from the rear sidewall 202*a* to the polishing surface 201 more easily, so that the slurry has a different flow distribution.

According to an embodiment, the first included angle θ1 between the rear sidewall 202*a* and the polishing surface 201 is an obtuse angle, meaning that the angle θ1 is greater than 90 degrees, for example from 100 degrees to 150 degrees, preferably from 120 degrees to 140 degrees. The second included angle θ2 between the front sidewall 202*b* and the polishing surface 201 is an acute angle, meaning that θ2 is less than 90 degrees, for example from 30 degrees to 80 degrees, preferably from 40 degrees to 60 degrees. Therefore, relative to the rotational direction 211 of the polishing pad 200, the inclined angles between the sidewalls of the grooves and the polishing surface 201 are sequentially acute angles and obtuse angles which are alternatively arranged. In other words, the groove sidewalls have, from bottom to top thereof, an inclined direction, and the inclined direction is the direction opposite to the rotational direction of the polishing pad 200. The inclined angle between the sidewalls and the vertical direction of the polishing surface is, for example, from 30 degrees to 80 degrees, preferably from 40 degrees and 60 degrees. In addition, the rear sidewall 202*a* and the front sidewall 202*b* may be parallel to each other, meaning that the sum of the first included angle θ1 and the second included angle θ2 is 180 degrees. Therefore, as the polishing layer is worn during the polishing process, a contact area of the polishing surface 201 is maintained the same.

Figure 2B:
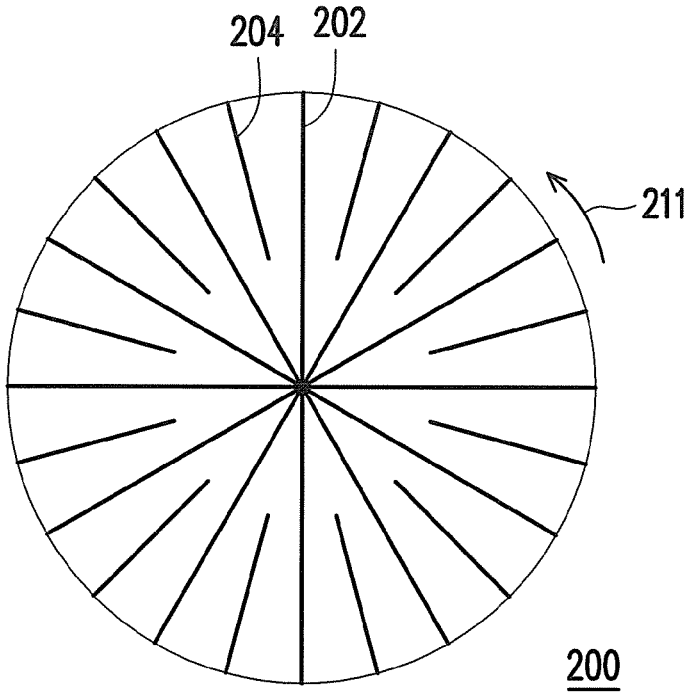
Figure 2C:
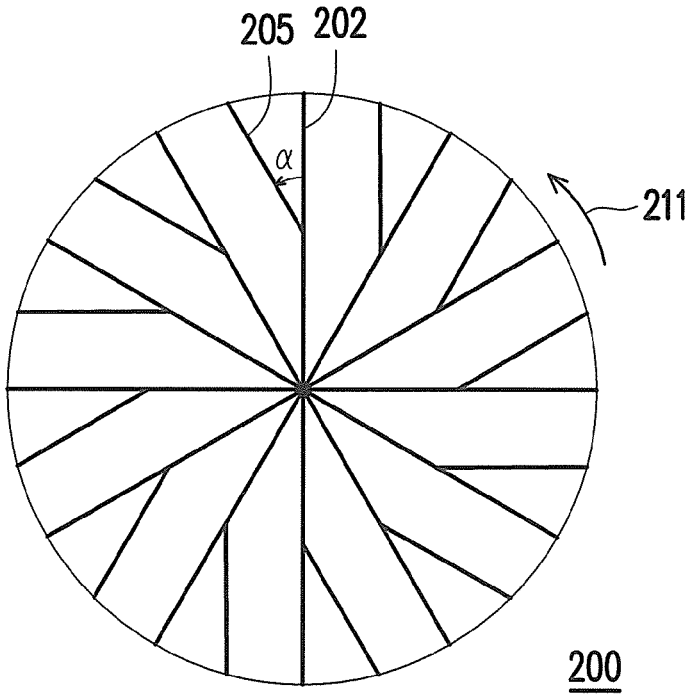

Besides disposing the grooves 202 in the polishing pad 200 as shown in FIG. 2A (the grooves 202 are hereby called the primary grooves, so as to be distinguished from following auxiliary grooves), other auxiliary grooves may also be disposed. As shown in FIG. 2B, besides the primary grooves 202 which are linear and disposed in a radial arrangement, auxiliary grooves 204 are also disposed between the primary grooves 202 in FIG. 2B. In addition, as shown in FIG. 2C, besides the primary grooves 202 which are linear and disposed in a radial arrangement, auxiliary grooves 205 are also disposed between the primary grooves 202, wherein an inner side end of each of the auxiliary grooves 205 is connected to the primary grooves 202, and the auxiliary grooves 205 have an included angle α with the primary grooves 202. A direction (from the primary grooves 202 to the auxiliary grooves 205) of the included angle α is the same as the rotational direction of the polishing pad 200. Using FIG. 2C as an example, the rotational direction of the polishing pad 200 is a positive direction (which is a counter-clockwise direction, as shown by the arrow 211), and the direction of the included angle α between the auxiliary grooves 205 and the primary grooves 202 is also a positive direction. For example, the included angle α is from 5 degrees to 45 degrees. The design of the auxiliary grooves 205 enables a part of the slurry to be absorbed back when the polishing pad 200 is rotating, so that the slurry has a different flow distribution. The above auxiliary grooves 204 and 205, for example, extend from a region of a radius to near the peripheral region, as shown in FIGS. 2B and 2C, so that the difference between densities of the grooves near the rotating central region and near the peripheral region is reduced. However, the invention is not limited thereto. The auxiliary grooves 204 and 205 may also extend from regions of different radii to near the peripheral region of the polishing pad 200.

In the above FIGS. 2B and 2C, the primary grooves 202 and the auxiliary grooves 204 and 205 have a plurality of groove cross sections along the circumferential direction of the same radius, and each of the groove cross sections has two sidewalls. Relative to the rotational direction 211 of the polishing pad 200, the rear sidewall and the polishing surface have the included angle which is an obtuse angle, so that the slurry flows from the rear sidewall of each of the grooves to the polishing surface more easily. Hence the slurry has a different flow distribution. Other further structures and characteristics are similar to those in FIG. 2A and are not repeatedly illustrated.

Figure 2D:
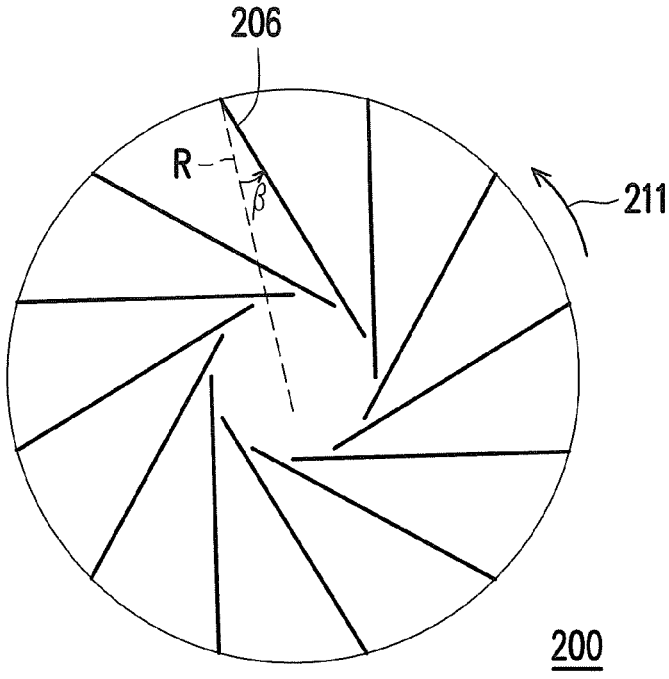

According to another embodiment, grooves 206 (the grooves 206 are hereby called the primary grooves, so as to be distinguished from following auxiliary grooves) may also be disposed in the polishing pad 200 as shown in FIG. 2D. The grooves 206 are linear and are disposed in a radial arrangement in the polishing layer, but virtual extension lines of the grooves 206 do not cross the rotational center. An end (inner side end) of each of the grooves 206 is near the rotating central region, and another end (outer side end) is near the peripheral region. The outer side end of each of the grooves 206 has a point of intersection with a radius R on the polishing pad 200, and the radius R has an included angle β with the grooves 206, and a direction (from the radius R to the grooves 206) of the included angle is the same as the rotational direction of the polishing pad 200. Using FIG. 2D as an example, the rotational direction of the polishing pad 200 is a positive direction (which is a counter-clockwise direction, as shown by the arrow 211), and the direction of the included angle β is also a positive direction. For example, the included angle β is from 1 degree to 30 degrees. The design of the grooves 206 enables a part of the slurry to be absorbed back when the polishing pad 200 is rotating, so that the slurry has a different flow distribution.

Figure 2E:
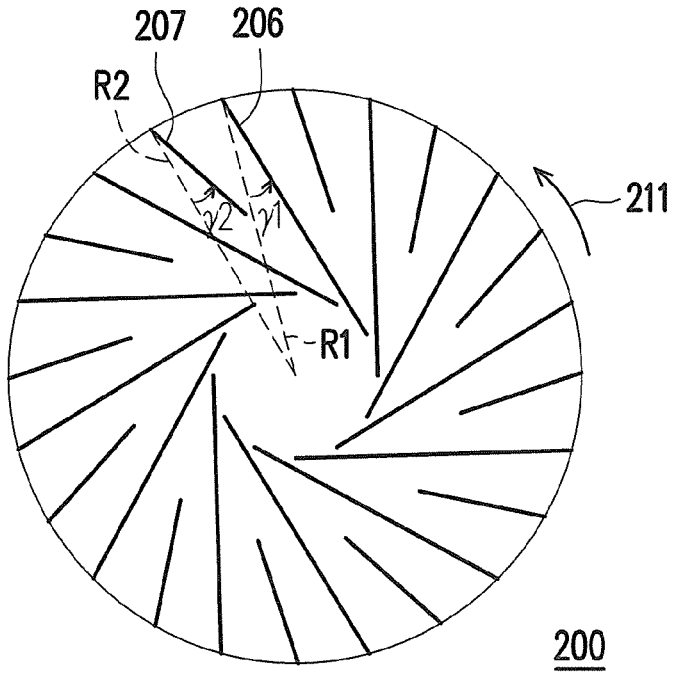

According to another embodiment of the invention, as shown in FIG. 2E, the polishing pad 200 of the present embodiment is similar to that in FIG. 2D. What is different is that besides the primary grooves 206, the polishing pad 200 in FIG. 2E further includes auxiliary grooves 207. The auxiliary grooves 207, for example, extend outward from a region of a radius to near the peripheral region, so that the difference between the densities of the grooves near the rotating central region and near the peripheral region is reduced. However, the invention is not limited thereto. The auxiliary grooves may also extend from regions of different radii to near the peripheral region of the polishing pad 200. In particular, the outer side end of each of the primary grooves 206 has a point of intersection with a radius R1 on the polishing pad 200, and the radius R has an included angle γ1 with the primary grooves 206, and a direction (from the radius R1 to the primary grooves 206) of the included angle is the same as the rotational direction 211 of the polishing pad 200. Moreover, the outer side end of each of the auxiliary grooves 207 has a point of intersection with a radius R2, and the radius R2 has an included angle γ2 with the auxiliary grooves 207, and a direction (from the radius R2 to the auxiliary grooves 207) of the included angle is also the same as the rotational direction 211 of the polishing pad 200. For example, the rotational direction of the polishing pad 200 is a positive direction (which is a counter-clockwise direction, as shown by arrow 211), the directions of the included angle γ1 and the included angle γ2 are both positive directions, and the angles γ1 and γ2 are respectively from 1 degree to 30 degrees. The design of the primary grooves 206 and the auxiliary grooves 207 enables a part of the slurry to be absorbed back when the polishing pad 200 is rotating, so that the slurry has a different flow distribution.

Figure 2F:
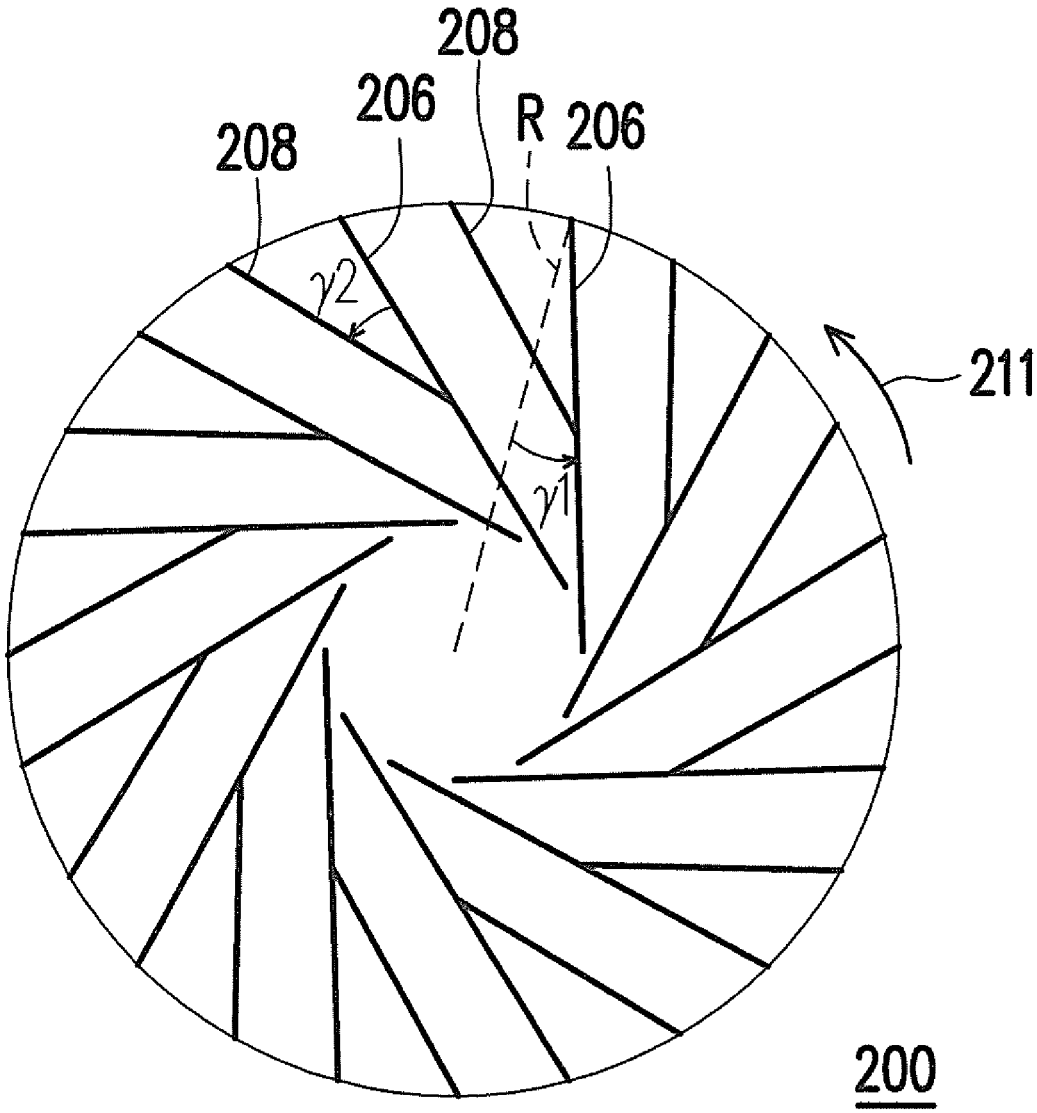

Still another embodiment of the invention, as shown in FIG. 2F, has the polishing pad 200 similar to that in FIG. 2D. The difference is that besides having the primary grooves 206, the polishing pad 200 in FIG. 2F further includes auxiliary grooves 208 disposed between the primary grooves 206, wherein an inner side end of each of the auxiliary grooves 208 is connected to the primary grooves 206. In addition, the above auxiliary grooves 208, for example, extend outward from a region of a radius to near the peripheral region, so that the difference between the densities of the grooves near the rotating central region and near the peripheral region is reduced. However, the invention is not limited thereto. The auxiliary grooves may also extend outward from regions of different radii to near the peripheral region of the polishing pad 200. In particular, the outer side end of each of the primary grooves 206 has a point of intersection with a radius R on the polishing pad 200, and the radius R has an included angle γ1 with the primary grooves 206, and a direction (from the radius R to the primary grooves 206) of the included angle is the same as the rotational direction 211 of the polishing pad 200. In addition, an inner side end of each of the auxiliary grooves 208 is connected with the primary grooves 206, and the auxiliary grooves 208 have an included angle γ2 with the primary grooves 206. A direction (from the primary grooves 206 to the auxiliary grooves 208) of the included angle γ2 is the same as the rotational direction 211 of the polishing pad 200. For example, the rotational direction of the polishing pad 200 is a positive direction (which is a counter-clockwise direction, as shown by the arrow 211), the directions of the included angle γ1 and the included angle γ2 are both positive directions, the included angle γ1 is, for example, from 1 degree to 30 degrees, and the included angle γ2 is, for example, from 5 degrees to 45 degrees. The design of the primary grooves 206 and the auxiliary grooves 208 enables a part of the slurry to be absorbed back when the polishing pad 200 is rotating, so that the slurry has a different flow distribution.

The primary grooves 206 in FIG. 2D and the primary grooves 206 and the auxiliary grooves 207 and 208 in FIGS. 2E and 2F have a plurality of groove cross sections along the circumferential direction of the same radius, and each of the groove cross sections has two sidewalls. Relative to the rotational direction 211 of the polishing pad 200, the rear sidewall and the polishing surface have the included angle which is an obtuse angle, so that the slurry flows from the rear sidewall of each of the grooves to the polishing surface more easily. Hence the slurry has a different flow distribution. Other further structures and characteristics are similar to those in FIG. 2A and are not repeatedly described.

Besides the above kinds of polishing pads having linear grooves, according to other embodiments of the invention, a single linear groove of the polishing pad may be replaced by multiple-segment-shaped (for example linear-segment-shaped) or hole-shaped (for example round-hole-shaped) grooves arranged as an arc, and the surface pattern formed thereby is disposed in the polishing layer in a radial arrangement.

Figure 3A:
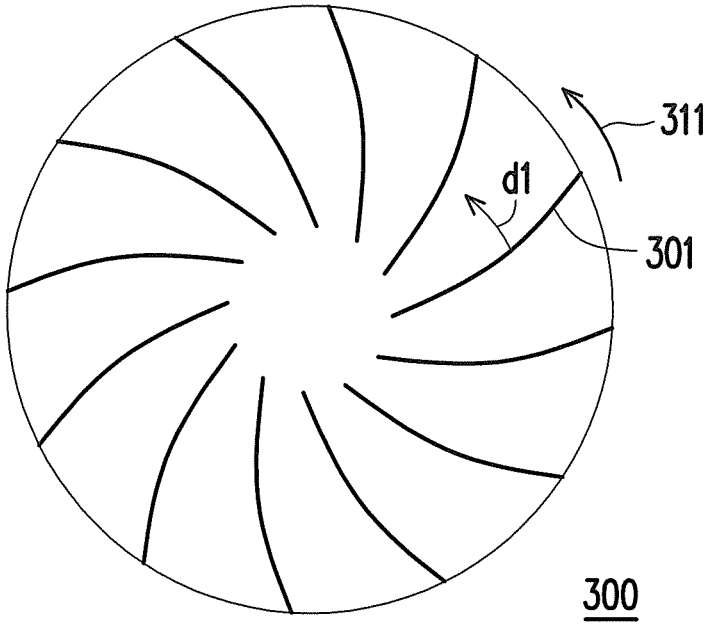
FIGS. 3A to 3C are each a top view of a polishing pad according to another embodiment of the present invention.
Figure 3B:
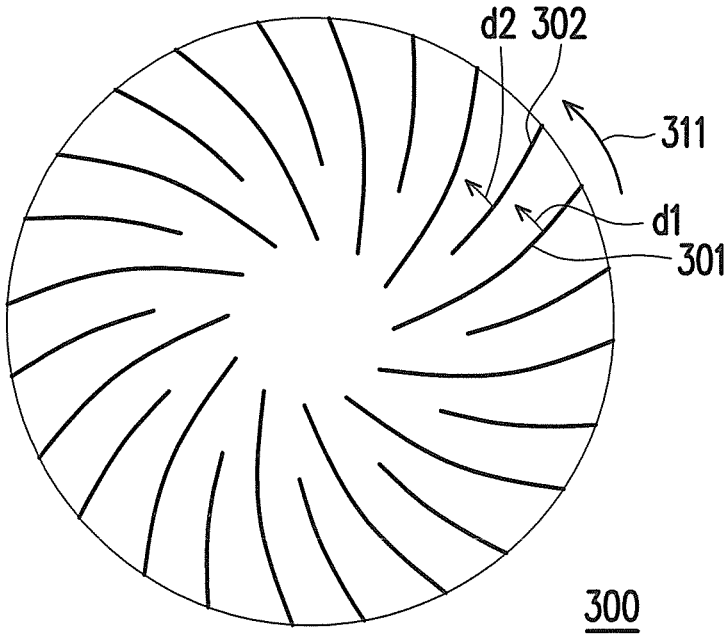
Figure 3C:
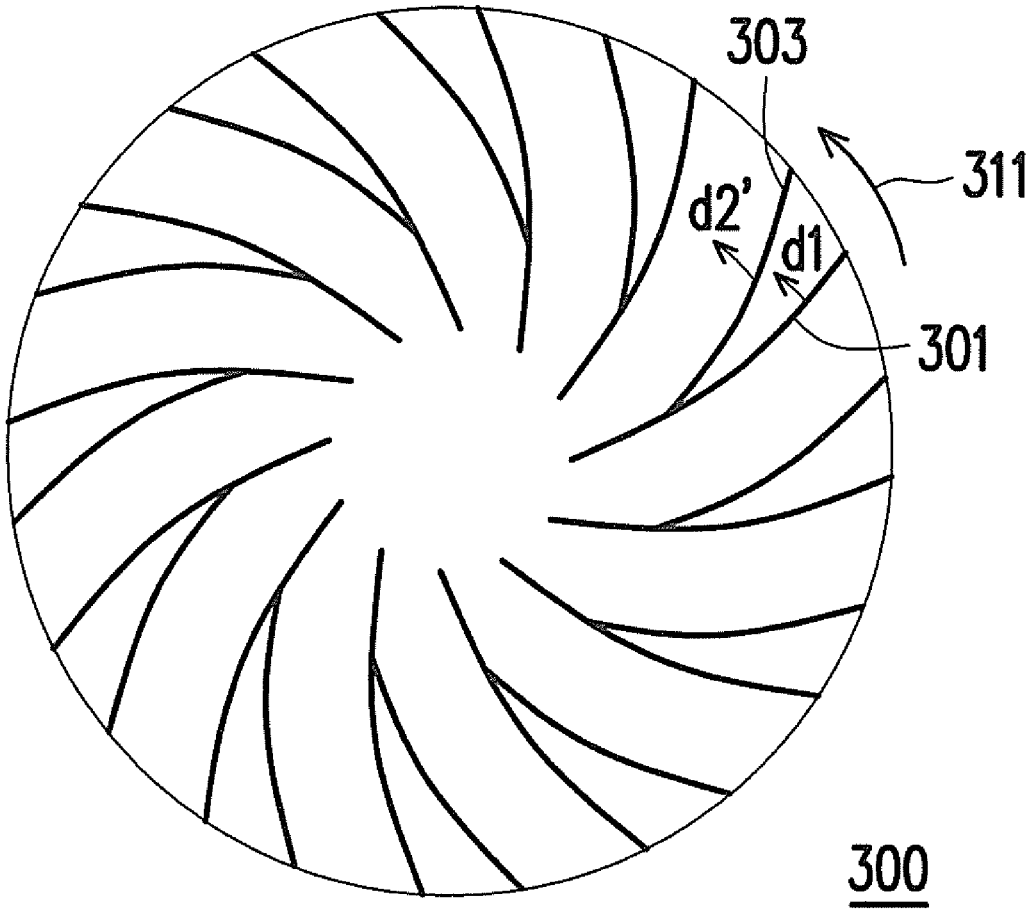

FIGS. 3A to 3C are each a top view of a polishing pad according to another embodiment of the invention. Here, a polishing pad 300 rotates counter-clockwise along a direction of an arrow 311. The polishing pad 300 in FIGS. 3A to 3C is only different from that in FIG. 2A by having grooves of different shapes. The other structures are the same or similar to those in FIG. 2A. In FIG. 3A, grooves 301 are arc-shaped, and a surface pattern formed thereby is disposed in a spiral arrangement in the polishing layer. In particular, the arc-shaped grooves 301 have a curvature so that they have a curved direction d1 inside-out, and the curved direction d1 is the same as the rotational direction 311 of the polishing pad 300. For example, the rotational direction of the polishing pad 300 is a positive direction (which is a counter-clockwise direction, as shown by the arrow 311), and the curved direction d1 is also a positive direction. The arc-shaped grooves 301 which have a spiral arrangement enable a part of the slurry to be absorbed back when the polishing pad 300 is rotating, so that the slurry has a different flow distribution.

In addition, according to another embodiment, as shown in FIG. 3B, the polishing pad 300 of the present embodiment is similar to that in FIG. 3A. What is different is that besides the arc-shaped grooves 301 (the grooves 301 are hereby called the arc-shaped primary grooves 301, so as to be distinguished from following auxiliary grooves), the polishing pad 300 in FIG. 3B further includes arc-shaped auxiliary grooves 302. The arc-shaped auxiliary grooves 302, for example, extend outward from a region of a radius to near the peripheral region, so that the difference between the densities of the grooves near the rotating central region and near the peripheral region is reduced. However, the invention is not limited thereto. The auxiliary grooves may also extend outward from regions of different radii to near the peripheral region of the polishing pad 300. In particular, the arc-shaped primary grooves 301 have the curved direction d1 inside-out, and the curved direction d1 is the same as the rotational direction 311 of the polishing pad 300. Moreover, the arc-shaped auxiliary grooves 302 have a curvature so that they have a curved direction d2 inside-out, and the curved direction d2 is also the same as the rotational direction 311 of the polishing pad 300. For example, the rotational direction of the polishing pad 300 is a positive direction (which is a counter-clockwise direction, as shown by the arrow 311), and the curved directions d1 and d2 are also positive directions. The arc-shaped primary grooves 301 and the arc-shaped auxiliary grooves 302 which have a spiral arrangement enable a part of the slurry to be absorbed back when the polishing pad 300 is rotating, so that the slurry has a different flow distribution.

Furthermore, another embodiment, as shown in FIG. 3C, has the polishing pad 300 which is similar to that in FIG. 3A. The difference is that besides having the arc-shaped primary grooves 301, the polishing pad 300 further includes arc-shaped auxiliary grooves 303, wherein an inner side end of each of the arc-shaped auxiliary grooves 303 is connected to the primary grooves 301. In addition, the above arc-shaped auxiliary grooves 303, for example, extend outward from a region of a radius to near the peripheral region, so that the difference between the densities of the grooves near the rotating central region and near the peripheral region is reduced. However, the invention is not limited thereto. The auxiliary grooves may also extend outward from regions of different radii to near the peripheral region of the polishing pad 300. In particular, the arc-shaped primary grooves 301 have the curved direction d1 inside-out, and the curved direction d1 is the same as the rotational direction 311 of the polishing pad 300. In addition, the arc-shaped auxiliary grooves 303 have a curved direction d2' inside-out, and the curved direction d2' is also the same as the rotational direction 311 of the polishing pad 300. For example, the rotational direction of the polishing pad 300 is a positive direction (which is a counter-clockwise direction, as shown by the arrow 311), and the curved directions d1 and d2' are also positive directions. The arc-shaped primary grooves 301 and the arc-shaped auxiliary grooves 303 which have a spiral arrangement enable a part of the slurry to be absorbed back when the polishing pad 300 is rotating, so that the slurry has a different flow distribution.

The above arc-shaped primary grooves 301 in FIG. 3A and the arc-shaped primary grooves 301 and the arc-shaped auxiliary grooves 302 and 303 in FIGS. 3B and 3C have a plurality of groove cross sections along the circumferential direction of the same radius, and each of the groove cross sections has two sidewalls. Relative to the rotational direction 311 of the polishing pad 300, a rear sidewall and the polishing surface have an included angle which is an obtuse angle, so that the slurry flows from the rear sidewall of each of the grooves to the polishing surface more easily. Hence the slurry has a different flow distribution. Other further structures and characteristics are similar to those in FIG. 2A and are not repeatedly illustrated.

Besides the above kinds of polishing pads having arc-shaped grooves, according to other embodiments of the invention, a single arc-shaped groove of the polishing pad may be replaced by multiple-segment-shaped (for example linear-segment-shaped or arc-segment-shaped) or hole-shaped (for example round-hole-shaped) grooves arranged as an arc, and the surface pattern formed thereby is disposed in the polishing layer in a spiral arrangement.

Figure 4A:
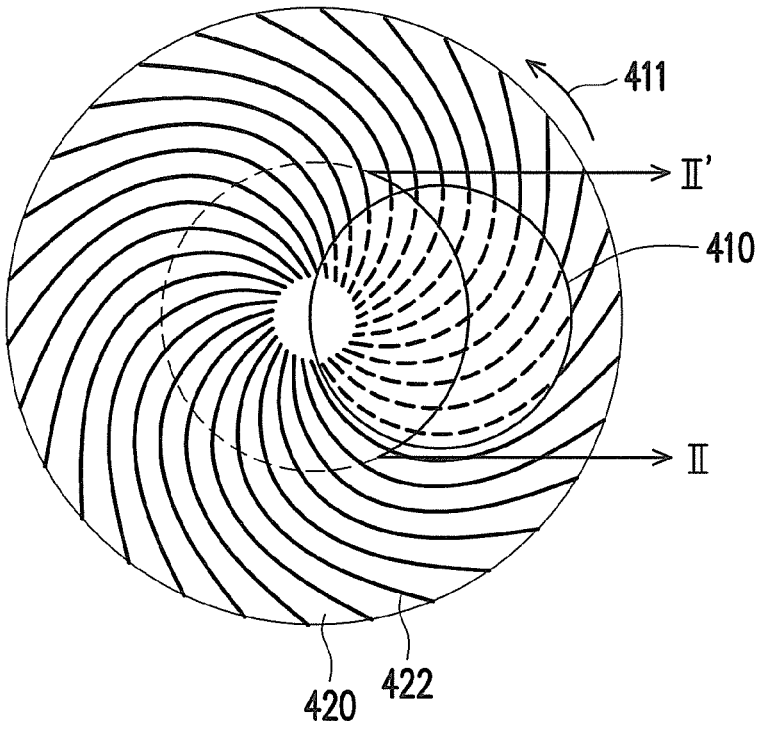
FIG. 4A is a top view of a polishing system according to an embodiment of the present invention.
Figure 4B:
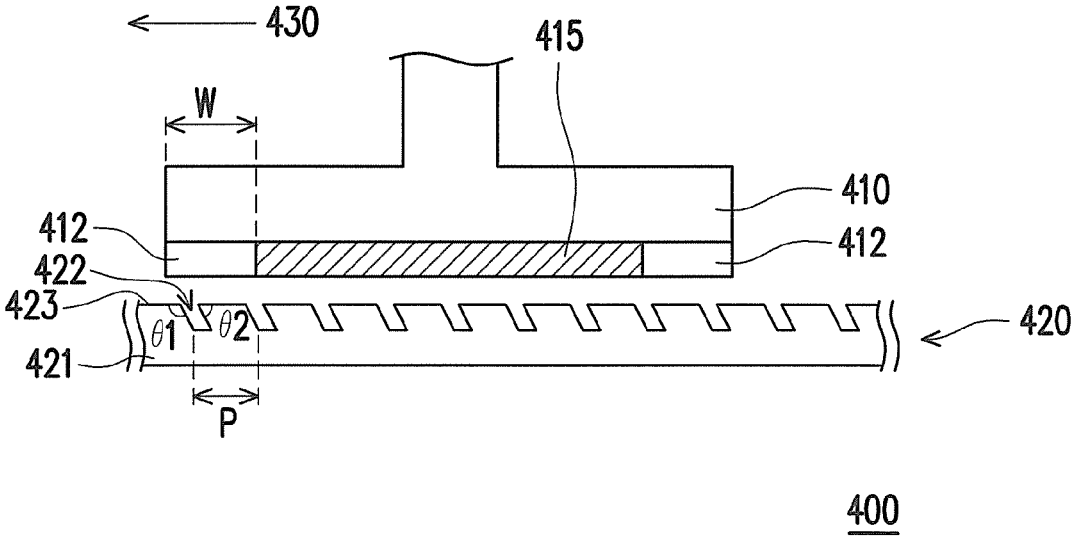
FIG. 4B is a cross-sectional schematic view taken along a line II-II' in FIG. 4A.

FIG. 4A is a top view of a polishing system according to an embodiment of the invention, and FIG. 4B is a schematic view of a cross-section II-II' along a part a region near a polishing track of a center of a polishing article 415 in FIG. 4A. Referring to both FIGS. 4A and 4B, a polishing system 400 includes a carrier 410 and a polishing pad 420. The polishing pad 420, for example, is fixed on a polishing platen which has a rotational direction 411 by using an adhering method or an attaching method. The carrier 410 is disposed on the polishing pad 420 and is used to hold the polishing article 415 on the polishing pad 420. Through rotation of the polishing pad 420 fixed on the polishing platen, relative motion is generated between the polishing pad 420 and the polishing article 415.

The polishing layer 421 of the polishing pad 420 has a polishing layer 423 and a surface pattern which is disposed in the polishing layer 421. The surface pattern includes a plurality of grooves 422 which extend outward from near the rotating central region to near the peripheral region. Moreover, the grooves 422 include a plurality of groove cross sections along a circumferential direction of a same radius, and each of the groove cross sections of the grooves 422 has a left sidewall and a right sidewall. An included angle formed by one of a group of the left sidewalls and a group of the right sidewalls and the polishing surface 423 is an obtuse angle. According to an embodiment, relative to the rotational direction 411 of the polishing pad 420, the included angle θ1 between the rear sidewall of each of the groove cross sections and the polishing surface 423 is an obtuse angle. In other words, relative to the rotational direction 411 of the polishing pad 420, the rear sidewall of each of the groove cross sections 422 has an inclined angle.

According to another embodiment, each of the two sidewalls of each of the two groove cross sections in the polishing pad 420 has an inclined direction. In other words, the included angle θ1 between the one of the sidewalls of each of the grooves 422 and the polishing surface 423 is an obtuse angle, meaning that the angle θ1 is greater than 90 degrees, for example from 100 degrees to 150 degrees, preferably from 120 degrees to 140 degrees. The included angle θ2 between the other sidewall and the polishing surface 423 is an acute angle, meaning that θ2 is less than 90 degrees, for example from 30 degrees to 80 degrees, preferably from 40 degrees to 60 degrees. Therefore, relative to the rotational direction 411 of the polishing pad 420, the inclined angles between the sidewalls of the grooves and the polishing surface 423 are sequentially acute angles and obtuse angles which are alternatively arranged. In other words, the groove sidewalls have, from bottom to top thereof, an inclined direction, and the inclined direction is the direction opposite to the rotational direction 411 of the polishing pad 420. The inclined angle between the sidewalls and the vertical direction of the polishing surface 423 is, for example, from 30 degrees to 80 degrees, preferably from 40 degrees and 60 degrees.

Using FIGS. 4A and 4B as an example, the rotational direction 411 of the polishing pad 420 is a counter-clockwise direction, and the grooves 422 have the plurality of groove cross sections along the circumferential direction. The inclined direction of the sidewalls of the groove cross sections is from upper left to lower right. In other words, relative to the rotational direction 411 of the polishing pad 420, the included angle θ2 between the front sidewall (which is the right sidewall) of each of the grooves 422 and the polishing surface 423 is less than 90 degrees, and the included angle θ1 between the rear sidewall (which is the left sidewall) and the polishing surface 423 is greater than 90 degrees.

According to an embodiment, the shape of the grooves 422 in the polishing pad 420 is similar to that of the grooves in FIG. 3A. In other words, the grooves 422 are arc-shaped. The surface pattern formed thereby is disposed in the polishing layer 421 in a spiral arrangement, and has the same curved direction as the rotational direction 411 of the polishing pad 420. Moreover, the carrier 410 has a holding ring 412 which surrounds the edge of the polishing article 415 fixed on the carrier 410, so that the polishing article 415 is held on the polishing pad 420. Furthermore, along the polishing track of the center of the polishing article 415, a distance P between two adjacent grooves is less than or equal to a width W of the holding ring 412. The above is caused by relative motion (shown by an arrow 430) between the carrier 410 and the polishing layer 421 and by contact between the holding ring 412 and the polishing pad 420. When the width W of the holding ring 412 is greater than or equal to the distance P between two adjacent grooves, the holding ring 412 presses the grooves 422 more easily, so that the slurry flows from the rear sidewall of each of the grooves to the polishing surface 423 more easily. Hence the slurry has a different flow distribution. According to an embodiment, the surface pattern of the polishing pad 420 has a spiral distribution and is formed by the plurality of arc-shaped grooves (the polishing pad 420 has characteristics similar to those of the polishing pad 300 in FIG. 3A and is not repeatedly described). In the region near the polishing track of the center of the polishing article 415, an outer edge (for example a front edge for relative motion to the polishing pad 420, meaning the left side in FIG. 4B) of the holding ring 412 has the same curvature as that of the grooves 422.

According to the present embodiment, the sidewalls on the same side of the grooves have the same included angle with the polishing surface 423. However, according to other embodiments, it is sufficient to make each of the grooves have the same inclined direction. The inclined angles of each of the grooves are not limited to be the same or to be different.

The following uses the above polishing system 400 as an example to further illustrate the invention. First, the polishing pad 420 is provided. The polishing pad 420 includes the polishing pad 421 and the grooves 422, and further structures and characteristics of the grooves 422 are similar to those in the above polishing system and are not repeatedly described.

Next, the polishing article 415 is disposed on the polishing pad 420, and relative motion between the polishing pad 420 and the polishing article 415 is generated through rotation of the polishing pad 420 (in the rotational direction 411), so that a polishing process is performed on the polishing article 415. The inclined direction, as shown by the arrow 430, of the rear sidewall of each of the grooves 422 is opposite to the rotational direction 411 of the polishing pad 420. Therefore, when there is relative motion between the polishing pad 420 and the polishing article 415, the slurry in the grooves 422 flow along the inclined rear sidewalls (for example the rear sidewalls of the grooves in FIG. 4B) to the polishing surface 423, so that the slurry has a different flow distribution.

The polishing method according to embodiments of the invention may be applied to polishing processes for manufacturing industrial devices. For example, it may be applied to devices in the electronic industry, such as to devices of semiconductors, integrated circuits, micro electro-mechanics, energy conversion, communication, optics, storage disks and displays. The polishing articles used for manufacturing the devices may include semiconductor wafers, III-V group wafers, storage device carriers, ceramic substrates, polymer substrates and glass substrates, but the invention is not limited thereto.

It should be noted that the grooves 422 in the above polishing system and polishing method are illustrated using arc shapes as examples, but the invention is not limited thereto. According to other embodiments, the shapes of the grooves may be linear, segment-shaped, hole-shaped or any combinations thereof, and the surface pattern may be disposed in the polishing layer 421 in a radial arrangement (as shown in FIGS. 2A to 2F) or disposed in the polishing layer 421 in a spiral arrangement (as shown in FIGS. 3A to 3C).

In summary, according to the above embodiments, the sidewalls of the grooves in the polishing pad have an inclined direction, so that when the inclined direction is along the opposite to the rotational direction of the polishing pad, the slurry flows along the inclined direction of sidewalls of the grooves to the surface of the polishing layer. The slurry thereby has a different flow distribution.

The rotational center defined in the embodiments of the invention is a position of an axis which the polishing pad rotates around. According to the embodiments of the invention, the rotational center and the center of the surface pattern overlap, and the polishing pad is exemplarily shown as circular, but the invention is not limited thereto. According to specific polishing requirements, the rotational center might not overlap with the center of the surface pattern of the polishing pad, and the polishing pad may be of other shapes. In addition, the grooves in the polishing pad in embodiments of the invention may be fabricated through mechanical methods (for example using a milling machine equipped with a drill or a saw), mold transfer printing methods, or etching methods (for example using chemical etching or laser processing), but the invention is not limited thereto; other methods may be used to fabricate the grooves.

The polishing pad, polishing system, and polishing method of the invention enables a different slurry flow distribution by using the polishing pad which makes the slurry have a different flow distribution. For some specific polishing processes, the slurry is utilized more efficiently, so that consumption and cost of using of the slurry are reduced. For other specific polishing processes, other polishing characteristics are obtained. For example, the polishing rate of the polishing article obtains different contour distributions, or polishing defects such as micro-scratches are reduced, so that industrial options are provided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A polishing pad, comprising:

a polishing layer, the polishing layer comprising a polishing surface, a rotating central region, and a peripheral region; and a surface pattern disposed in the polishing layer, the surface pattern comprising at least a plurality of grooves, each groove of the plurality of grooves distributed from near the rotating central region and extending outward to near the peripheral region, wherein the grooves comprise a plurality of groove cross sections along a circumferential direction of a same radius, each of the groove cross sections has a left sidewall and a right sidewall, a first included angle is formed by the polishing surface and one of a group of the left sidewalls and a group of the right sidewalls, and the first included angle is an obtuse angle.

2. The polishing pad of claim 1, wherein an end of at least one of the grooves is near the rotating central region, and another end is near the peripheral region.

3. The polishing pad of claim 1, wherein at least one of the grooves crosses near the rotating central region, and two ends of the grooves are near the peripheral region.

4. The polishing pad of claim 1, wherein a shape of the grooves is a linear shape, an arc shape, a segment shape, a hole shape, or a combination thereof.

5. The polishing pad of claim 1, wherein the surface pattern is disposed in a radial arrangement or spiral arrangement.

6. The polishing pad of claim 1, wherein the left sidewall and the right sidewall of each of the groove cross sections are parallel to each other.

7. The polishing pad of claim 1, wherein a second included angle is formed by the polishing surface and another one of the group of the left sidewalls and the group of the right sidewalls, and the second included angle is an acute angle.

8. The polishing pad of claim 7, wherein the first included angle is from 100 degrees to 150 degrees, and the second included angle is from 30 degrees to 80 degrees.

9. The polishing pad of claim 1, wherein the polishing pad has a rotational direction, and the sidewall having the first included angle is a rear sidewall relative to the rotational direction.

10. A polishing pad suitable for a polishing system having a rotational direction, comprising:

a polishing layer, the polishing layer comprising a polishing surface, a rotating central region, and a peripheral region; and a surface pattern disposed in the polishing layer, the surface pattern comprising at least a plurality of grooves, each groove of the plurality of grooves distributed from near the rotating central region and extending outward to near the peripheral region, wherein the grooves comprise a plurality of groove cross sections along a circumferential direction of a same radius, each of the groove cross sections has a left sidewall and a right sidewall, the left sidewalls and the right sidewalls have an inclined direction from bottom to top thereof, and the inclined direction is opposite to the rotational direction.

11. The polishing pad of claim 10, wherein a shape of the grooves is a linear shape, an arc shape, a segment shape, a hole shape, or a combination thereof.

12. The polishing pad of claim 10, wherein the surface pattern is disposed in a radial arrangement or spiral arrangement.

13. The polishing pad of claim 10, wherein the left sidewall and the right sidewall of each of the groove cross sections are parallel to each other.

14. The polishing pad of claim 10, wherein an included angle between the left and right sidewalls and a perpendicular direction of the polishing surface is from 30 degrees to 80 degrees.

15. A polishing system, comprising:

a carrier, used to hold a polishing article; and a polishing pad, fixed on a polishing platen, the polishing pad comprising:

a polishing layer, the polishing layer comprising a polishing surface, a rotating central region, and a peripheral region; and a surface pattern disposed in the polishing layer, the surface pattern comprising at least a plurality of grooves, each groove of the plurality of grooves distributed from near the rotating central region and extending outward to near the peripheral region, wherein the grooves comprise a plurality of groove cross sections along a circumferential direction of a same radius, each of the groove cross sections has a left sidewall and a right sidewall, a first included angle is formed by the polishing surface and one of a group of the left sidewalls and a group of the right sidewalls, and the first included angle is an obtuse angle.

16. The polishing system of claim 15, wherein an end of at least one of the grooves is near the rotating central region, and another end is near the peripheral region.

17. The polishing system of claim 15, wherein at least one of the grooves crosses near the rotating central region, and two ends of the grooves are near the peripheral region.

18. The polishing system of claim 15, wherein a shape of the grooves is a linear shape, an arc shape, a segment shape, a hole shape, or a combination thereof.

19. The polishing system of claim 15, wherein the surface pattern is disposed in a radial arrangement or spiral arrangement.

20. The polishing system of claim 15, wherein the left sidewall and the right sidewall of each of the groove cross sections are parallel to each other.

21. The polishing system of claim 15, wherein a second included angle is formed by the polishing surface and another one of the group of the left sidewalls and the group of the right sidewalls, and the second included angle is an acute angle.

22. The polishing system of claim 21, wherein the first included angle is from 100 degrees to 150 degrees, and the second included angle is from 30 degrees to 80 degrees.

23. The polishing system of claim 15, wherein the polishing platen has a rotational direction, and the sidewall having the first included angle is a rear sidewall relative to the rotational direction.

24. The polishing system of claim 15, wherein the carrier further comprises a holding ring used to hold the polishing article on the polishing pad, and along a polishing track of a center of the polishing article, a distance between two adjacent grooves is less than or equal to a width of the holding ring.

25. The polishing system of claim 24, wherein the grooves are arc-shaped and have a same curvature as an outer edge of the holding ring.

26. A polishing system, comprising:

a carrier, used to hold a polishing article; and a polishing pad, fixed on a polishing platen which has a rotational direction, the polishing pad comprising:

a polishing layer, the polishing layer comprising a polishing surface, a rotating central region, and a peripheral region; and a surface pattern disposed in the polishing layer, the surface pattern comprising at least a plurality of grooves, each groove of the plurality of grooves distributed from near the rotating central region and extending outward to near the peripheral region, wherein the grooves comprise a plurality of groove cross sections along a circumferential direction of a same radius, each of the groove cross sections has a left sidewall and a right sidewall, the left sidewalls and the right sidewalls have an inclined direction from bottom to top thereof, and the inclined direction is opposite to the rotational direction.

27. The polishing system of claim 26, wherein a shape of the grooves is a linear shape, an arc shape, a segment shape, a hole shape, or a combination thereof.

28. The polishing system of claim 26, wherein the surface pattern is disposed in a radial arrangement or spiral arrangement.

29. The polishing system of claim 26, wherein the left sidewall and the right sidewall of each of the groove cross sections are parallel to each other.

30. The polishing pad of claim 26, wherein an included angle between the left and right sidewalls and a perpendicular direction of the polishing surface is from 30 degrees to 80 degrees.

31. The polishing system of claim 26, wherein the carrier further comprises a holding ring used to hold the polishing article on the polishing pad, and along a polishing track of a center of the polishing article, a distance between two adjacent grooves is less than or equal to a width of the holding ring.

32. The polishing system of claim 31, wherein the grooves are arc-shaped and have a same curvature as an outer edge of the holding ring.

33. A polishing method for manufacturing an industrial device, comprising:

using a polishing pad to polish a polishing article, wherein the polishing pad rotates along a rotational direction, the polishing pad comprising:

a polishing layer, the polishing layer comprising a polishing surface, a rotating central region, and a peripheral region; and a surface pattern disposed in the polishing layer, the surface pattern comprising at least a plurality of grooves, each groove of the plurality of grooves distributed from near the rotating central region and extending outward to near the peripheral region, wherein the grooves comprise a plurality of groove cross sections along a circumferential direction of a same radius, each of the groove cross sections has a left sidewall and a right sidewall, a first included angle is formed by the polishing surface and one of a group of the left sidewalls and a group of the right sidewalls, and the first included angle is an obtuse angle.

34. The polishing method of claim 33, wherein an end of at least one of the grooves is near the rotating central region, and another end is near the peripheral region.

35. The polishing method of claim 33, wherein at least one of the grooves crosses near the rotating central region, and two ends of the grooves are near the peripheral region.

36. The polishing method of claim 33, wherein a shape of the grooves is a linear shape, an arc shape, a segment shape, a hole shape, or a combination thereof.

37. The polishing method of claim 33, wherein the surface pattern is disposed in a radial arrangement or spiral arrangement.

38. The polishing method of claim 33, wherein the left sidewall and the right sidewall of each of the groove cross sections are parallel to each other.

39. The polishing system of claim 33, wherein a second included angle is formed by the polishing surface and another one of the group of the left sidewalls and the group of the right sidewalls, and the second included angle is an acute angle.

40. The polishing method of claim 39, wherein the first included angle is from 100 degrees to 150 degrees, and the second included angle is from 30 degrees to 80 degrees.

41. The polishing method of claim 33, wherein the sidewall which has the first included angle is a rear sidewall relative to the rotational direction.

42. The polishing method of claim 33, further comprising using a carrier which has a holding ring, so as to hold the polishing article on the polishing pad, wherein along a polishing track of a center of the polishing article, a distance between two adjacent grooves is less than or equal to a width of the holding ring.

43. The polishing method of claim 42, wherein the grooves are arc-shaped and have a same curvature as an outer edge of the holding ring.

44. A polishing method for manufacturing an industrial device, comprising:

using a polishing pad to polish a polishing article, wherein the polishing pad rotates along a rotational direction, the polishing pad comprising:

a polishing layer, the polishing layer comprising a polishing surface, a rotating central region, and a peripheral region; and a surface pattern disposed in the polishing layer, the surface pattern comprising at least a plurality of grooves, each groove of the plurality of grooves distributed from near the rotating central region and extending outward to near the peripheral region, wherein the grooves comprise a plurality of groove cross sections along a circumferential direction of a same radius, each of the groove cross sections has a left sidewall and a right sidewall, the left sidewalls and the right sidewalls have an inclined direction from bottom to top thereof, and the inclined direction is opposite to the rotational direction.

45. The polishing method of claim 44, wherein a shape of the grooves is a linear shape, an arc shape, a segment shape, a hole shape, or a combination thereof.

46. The polishing method of claim 44, wherein the surface pattern is disposed in a radial arrangement or spiral arrangement.

47. The polishing method of claim 44, wherein the left sidewall and the right sidewall of each of the groove cross sections are parallel to each other.

48. The polishing pad of claim 44, wherein an included angle between the left and right sidewalls and a perpendicular direction of the polishing surface is from 30 degrees to 80 degrees.

49. The polishing method of claim 44, further comprising using a carrier which has a holding ring, so as to hold the polishing article on the polishing pad, wherein along a polishing track of a center of the polishing article, a distance between two adjacent grooves is less than or equal to a width of the holding ring.

50. The polishing method of claim 49, wherein the grooves are arc-shaped and have a same curvature as an outer edge of the holding ring.

* * * * *